United States Patent [19]

McNeil

[11] Patent Number: 4,630,401

[45] Date of Patent: Dec. 23, 1986

[54] FINISHING MACHINE AND METHOD

[75] Inventor: Gary L. McNeil, Allegan, Mich.

[73] Assignee: Roto-Finish Company, Inc., Kalamazoo, Mich.

[21] Appl. No.: 680,300

[22] Filed: Dec. 11, 1984

[51] Int. Cl.[4] ..... B24B 31/06; B24B 1/00

[52] U.S. Cl. ..... 51/7; 51/163.1; 51/318

[58] Field of Search ..... 51/6, 7, 17, 18, 313, 51/163.1, 315, 317–318, 164.1

[56] References Cited

U.S. PATENT DOCUMENTS

| | | | |
|---|---|---|---|
| 2,387,140 | 10/1945 | Fruth | 51/6 |
| 3,608,243 | 9/1971 | Ferrara | 51/163.1 |
| 3,624,970 | 12/1971 | Balz | 51/163.1 |
| 3,643,379 | 2/1972 | Testolin | 51/17 |
| 3,680,266 | 8/1972 | Shiplov | 51/163.1 |
| 4,499,692 | 2/1985 | Balz | 51/313 |

FOREIGN PATENT DOCUMENTS

| | | | |
|---|---|---|---|
| 0107767 | 7/1982 | Japan | 51/163.1 |
| 0667386 | 6/1979 | U.S.S.R. | 51/7 |
| 0889401 | 12/1981 | U.S.S.R. | 51/163.1 |

*Primary Examiner*—Frederick R. Schmidt
*Assistant Examiner*—Robert A. Rose
*Attorney, Agent, or Firm*—Gordon W. Hueschen

[57] ABSTRACT

A novel method for the surface-planing of elongated parts, in which the parts are not submerged in the finishing media, and in which the direction of the finishing media orbit is in the direction of feed or of the longitudinal dimension of the part, is disclosed, as well as novel open-top finishing machines, comprising finishing chambers having internal flow diverters, and side walls lower than front and back walls, all especially adapted for carrying out the surface-planing method of the invention.

41 Claims, 15 Drawing Figures

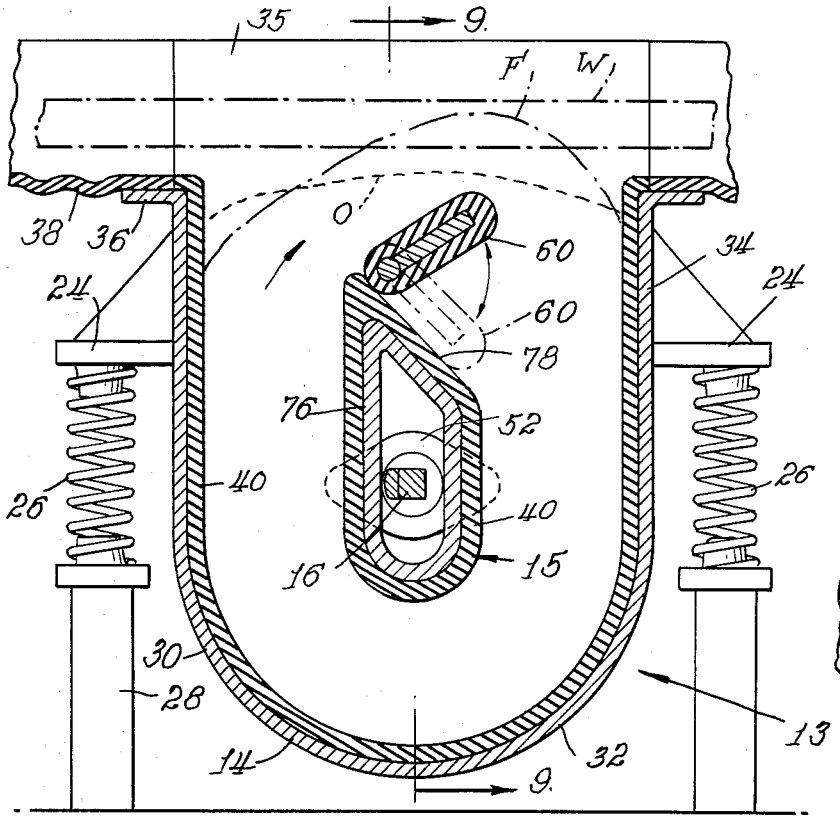
Fig. 8
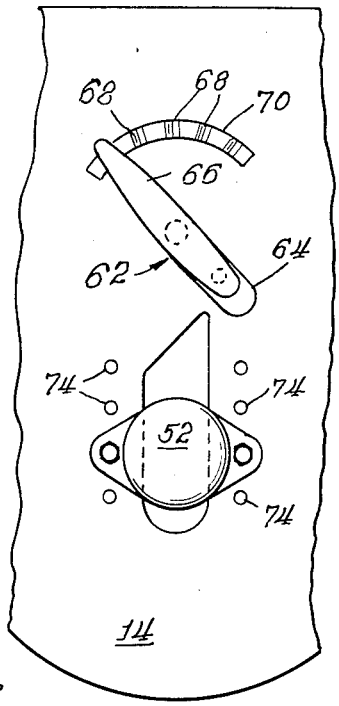
Fig. 10
Fig. 9
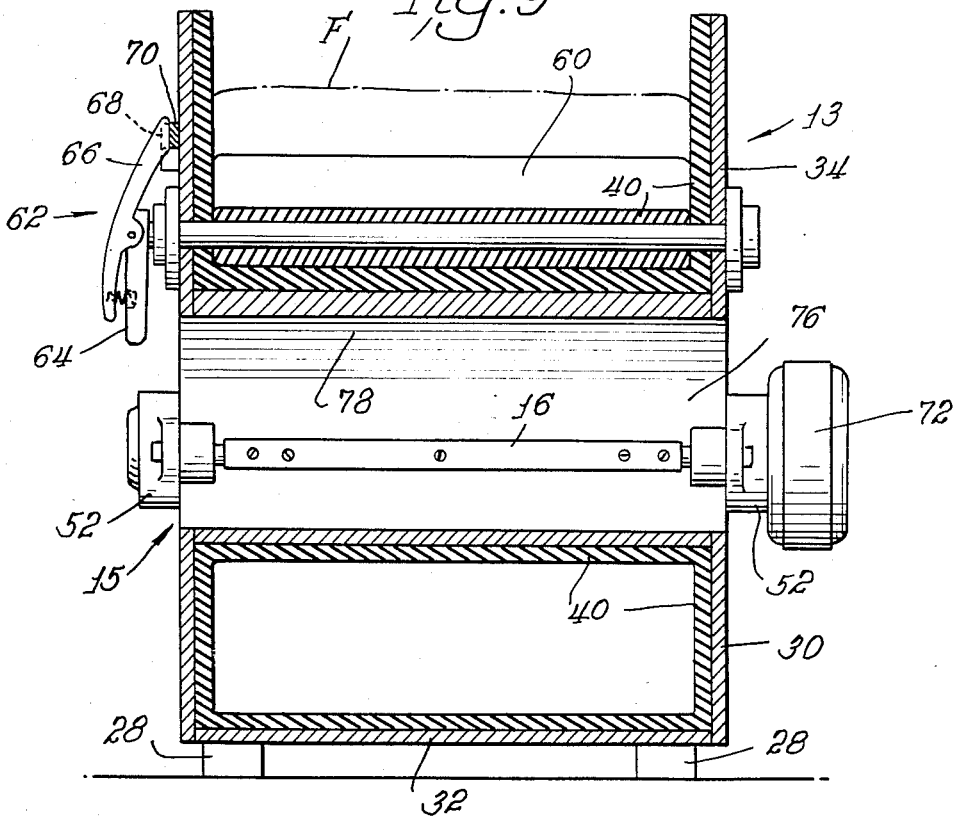

FINISHING MACHINE AND METHOD

BACKGROUND OF THE INVENTION

1. Field of Invention

Vibratory finishing; vibratory surface-planing; vibratory finishing machines of unique structure particularly adapted for vibratory surface-planing of elongated parts or workpieces; finishing chambers for such machines; method of vibratory surface-planing of elongated parts or workpieces.

2. Prior Art

The prior art is replete with vibratory finishing machines and methods of employing the same for the surface finishing of parts or workpieces, including elongated parts or workpieces. Representative U.S. Patents in this field include Balz U.S. Pat. No. 3,161,993 of Dec. 22, 1964, the corresponding U.S. Pat. No. Re. 27,084 of Mar. 2, 1971, and U.S. Pat. No. 3,624,970 of Dec. 7, 1971. Although these machines and methods have met with considerable commercial success, there have previously been no vibratory finishing machines or methods uniquely adapted for the vibratory surface-planing of parts or workpieces, particularly elongated parts or workpieces, and especially such means and method which have not required the submergence of the part or workpiece in loose particulate finising media employed in such machine or process. Moreover, for the surface-planing without submergence of elongated parts or workpieces, it has been found necessary that the orbital flow, ordinarily imparted to loose particulate finishing media in the course of a vibratory finishing process, for purposes of satisfactory surface-planing operation, be caused to orbit in a direction which is approximately normal to the direction usually employed during the course of previous vibratory surface finishing operations, unless the workpiece to be planed itself has an arcuate surface, so that an arcuate impression from the orbiting finishing media is not an undesirable aspect or result of the process. The most recent development in this art known to me, represented by Balz U.S. Ser. No. 389,005, filed June 16, 1982, now U.S. Pat. No. 4,499,692, also suffers from the previously-mentioned disadvantages of the necessity of submergence of the part or workpiece in the media and also from the standpoint that the direction of orbital motion of the finishing media is in the wrong direction for it to be universally applicable to the surface-planing of elongated parts.

It is apparent that the prior art leaves much to be desired from the standpoint of providing vibratory finishing apparatus which is particularly adapted for the surface-planing of elongated parts with loose particulate finishing media, finishing chambers adapted for use in such vibratory finishing apparatus, and methods for the vibratory surface-planing of elongated parts or workpieces, particularly without submergence of the part or workpiece in the loose particulate finishing media. Such shortcomings of the prior art are remedied by the provision of the finishing apparatus, finishing chamber, and finishing method of the present invention, all of which are particularly adapted for the vibratory surface-planing of elongated parts or workpieces, and most especially without the necessity of submerging the part or workpiece within the orbiting and vibrating body of loose particulate finishing media.

OBJECTS OF THE INVENTION

It is accordingly an object of the present invention to provide a vibratory finishing machine which is particularly adapted for the surface-planing of elongated parts with loose particulate finishing media, especially without the necessity of submerging the part or workpiece within the vibrating and orbiting body of finishing media. It is a further object of the invention to provide a novel method for the vibratory surface-planing of a part or workpiece, particularly an elongated part or workpiece, and especially such a method which does not require that the part or workpiece be submerged in the vibrating and orbiting body of finishing media. A still further object is the provision of such a vibratory surface-planing device having a series of side-by-side arranged finishing machines, which are connected together in side-by-side relationship, side wall adjacent to side wall, with connectors spanning adjacent side walls and preferably also adjacent front and back walls, thereby providing a support for an elongated part to be finished and a channel within which an elongated part can be positioned for contacting finishing media orbiting within said finishing chamber of said finishing machine. Still a further object of the invention is to provide such a surface-planing machine having a finishing chamber with an internal flow diverter mounted internally of said chamber between front and back walls thereof and located generally centrally of said chamber, and especially such a diverter which is hollow and/or generally cylindrical and/or having at least one protuburance on the surface thereof and/or is adjustable, all for purposes of diverting the internal flow of the finishing media for purposes of creating and/or adjusting the orbital motion thereof so as to bring the orbiting finishing media to an open top of a confining finishing chamber for purposes of contacting the part or workpiece at the upper portion of its orbit. Still another object of the invention is the provision of such a machine and method wherein the media is caused to orbit in a direction corresponding to the longitudinal dimension and/or direction of feed of the part or workpiece being finished, and yet another object of the invention is the provision of such a method wherein the upper portion of the orbiting finishing material is caused to come into contact with and to effect surface-planing of the part or workpiece at the upper portion of said orbit without submergence of said part or workpiece in said media. Additional objects and advantages will be apparent to one skilled in the art and still other advantages and objects will become apparent hereinafter.

SUMMARY OF THE INVENTION

The present invention comprises, inter alia, the following:

A machine for the vibratory surface-planing of an elongated part or workpiece which comprises means for causing loose particulate finishing media to undergo vibration and orbital motion in a confining chamber having upwardly-extending walls and an open top to produce an orbit having an upper portion and a lower portion, means for causing the upper portion of said orbit to extend at least to the open top of said chamber, and means for exposing the surface of the elongated part or workpiece to be finished to said orbiting finishing material without submergence in said media by positioning said surface in contact with said orbiting finishing media at the upper portion of its orbit; such machine including means for causing the upper portion of said orbit to extend above at least two walls of said chamber; such machine including means for causing the said media to orbit in a direction corresponding to the longitudinal dimension of said part; such machine including means for controlling the direction of longitudinal movement of the part or workpiece by controlling the direction of orbital flow of the media in the chamber; and such machine including means for maintaining a plurality of bodies of media in series and for maintaining different directions of orbital flow in different bodies of media.

Further, a machine for the vibratory surface-planing of an elongated part having a longitudinal and a transverse dimension comprising means for providing a body of loose particulte finishing media, means for imparting orbital flow to said media from the bottom to the top thereof to produce an orbit having a top portion and a bottom portion, means for subjecting a surface of said elongated part to the action of said media at the top portion of said orbit thereof, and means for causing said media to orbit in a direction corresponding to the longitudinal dimension of said part; such machine including means for causing said media to orbit in a direction corresponding to the direction of feed of said elongated part; such machine including means for providing a plurality of bodies of media sequentially, means for imparting orbital motion to said media in at least one of said bodies in a direction corresponding to the longitudinal dimension of said part, and means for imparting orbital motion to said media in at least one of said bodies of finishing media in a direction opposite to the longitudinal dimension of said part; and such machine including means for providing a plurality of bodies of media sequentially, means for imparting orbital motion to said media in at least one of said bodies in the direction of feed of said part, and means for imparting orbital motion to said media in at least one of said bodies of finishing media in a direction opposite to the direction of feed of said part.

Additionally, such a vibratory finishing machine particularly adapted for the surface planing of elongated parts with loose particulate finishing media comprising a chamber in the form of a tub having an open top and upwardly-extending side walls and an arcuate bottom extending between said upwardly-extending side walls, vertically-extending front and back walls, an internal flow diverter mounted internally of said chamber between the front and back walls thereof and located generally centrally of said chamber, a fixed base, means on said fixed base for resilient mounting of said chamber, and vibratory means to impart orbital motion to said chamber and to loose particulate finishing media, when deposited therein, around said internal flow diverter and between said vertically-extending front and back walls of said chamber, the upwardly-extending side walls providing support means upon which an elongated part can be positioned for contacting orbiting finishing media when said finishing media is vibrated to cause orbital motion thereof; a vibratory finishing machine particularly adapted for the surface planing of elongated parts with loose particulate finishing media comprising a chamber in the form of a tub having an open top and upwardly-extending side walls and an arcuate bottom extending between said upwardly-extending side walls, vertically-extending front and back walls, said front and back walls extending vertically above said side walls, an internal flow diverter mounted internally of said chamber between the front and back walls thereof and located generally centrally of said chamber, a fixed base, means on said fixed base for resilient mounting of said chamber, and vibratory means to impart orbital motion to said chamber and to loose particulate finishing media, when deposited therein, around said internal flow diverter and between said vertically-extending front and back walls of said chamber, the vertically-extending front and back walls providing a channel in which an elongated part can be positioned for contacting orbiting finishing media when said finishing media is vibrated to cause orbital motion thereof; such machine wherein said internal flow diverter is hollow; such machine wherein said internal flow diverter is generally cylindrical; such machine wherein said internal flow diverter is generally cylindrical with at least one protuberance on the surface thereof; such machine wherein said internal flow-diverter is adjustable for purposes of changing the flow diversion of finishing media by said internal flow diverter; such machine wherein said vibratory means comprises a shaft journalled in the front and back walls of said chamber carrying an eccentric weight, and means for rotatably driving said shaft; such machine including external pulley means and belt and motor means for driving said vibratory means; such machine wherein said internal flow diverter is hollow and wherein said shaft is located interior of said hollow internal flow diverter; such machine wherein a plurality of said machines are disposed in side-by-side relationship, with side wall adjacent to side wall, and are connected in series by connectors, said connectors spanning adjacent side walls; such machine wherein said connectors also span adjacent front and back walls; such machine wherein said connectors form a support for an elongated part to be finished; such machine wherein a plurality of said machines are connected in series, with elastomeric connectors or boots between adjacent machines, said connectors extending generally horizontally between adjacent side walls of adjacent machines and generally vertically between adjacent front and back walls of adjacent machines; such machine wherein the resilient mounting means on the respective bases of adjacent machines are staggered so as to permit location of said machines in close proximity to each other; such machine wherein the connectors connecting said machines span the respective side walls of adjacent machines and comprise substantially horizontal sections at the level of adjacent side walls of adjacent machines and essentially vertical walls which extend above the adjacent side walls of adjacent machines; such machine wherein the connectors have essentially vertical walls which are aligned with the vertical front and back walls to form a continuous channel in which an elongated part can be positioned; such machine wherein the connectors connecting said machines have a vertical section extending between adjacent vertical front and back walls of adjacent machines to act as a guide for the elongated part being finished and as a dike to prevent finishing media from spilling outside of adjacent chambers between adjacent machines; such machine wherein said essentially vertical walls extend essentially vertically to a height which is substantially the same as the height of the adjacent chamber front and back walls; such machine wherein different machines included in said plurality of machines include means for imparting vibrational orbital motion to different chambers in different directions; such machine wherein said vibratory means comprises a shaft journalled in the front and back walls of said chamber carrying an eccentric weight, and means for rotatably driving said shaft; such machine including external pulley means and belt and motor means for driving said vibratory means; such machine including hold-down means for holding said surface of said part or workpiece to be finished in contact with said finishing media; such machine wherein said hold-down means comprises a roller; and such machine wherein said roller is resiliently mounted.

Also, a method for the vibratory surface-planing of an elongated part or workpiece which comprises the step of causing loose particulate finishing media to undergo orbital motion in a confining chamber having an open top to produce an orbit having an upper portion and a lower portion, causing the upper portion of said orbit to extend at least to the open top of said chamber, and exposing the surface of an elongated part or workpiece to be finished to said orbiting finishing material without submergence in said media by positioning said surface in contact with said orbiting finishing media at the upper portion of its orbit; such a method wherein the upper portion of said orbit is caused to extend above at least two walls of said chamber; such a method wherein the said media is caused to orbit in a direction corresponding to the longitudinal dimension of said part; such a method including the step of floating the part or workpiece on a portion of the media at the upper portion of the orbital flow thereof; such a method including the step of controlling the direction of longitudinal movement of the part or workpiece by controlling the direction of orbital flow of the media in the chamber.

Moreover, a method of vibratory surface-planing of an elongated part having a longitudinal and a transverse dimension comprising the steps of providing a body of loose particulate finishing media, imparting orbital flow to said media from the bottom to the top thereof to produce an orbit having a top portion and a bottom portion, and subjecting a surface of said elongated part to the action of said media at the top portion of said orbit thereof, the said media being caused to orbit in a direction corresponding to the longitudinal dimension of said part; such a method wherein said media is caused to orbit in a direction corresponding to the direction of feed of said elongated part; such a method wherein a plurality of bodies of media are provided sequentially and wherein the orbital motion imparted to said media in at least one of said bodies is in a direction corresponding to the longitudinal dimension of said part and wherein the orbital motion imparted to said media in at least one of said bodies of finishing media is in a direction opposite to the longitudinal dimension of said part; and such a method wherein a plurality of bodies of media are provided sequentially and wherein the orbital motion imparted to said media in at least one of said bodies is in the direction of feed of said part and wherein the orbital motion imparted to said media in at least one of said bodies of finishing media is in a direction opposite to the direction of feed of said part.

Also, a chamber, for use in a vibratory finishing machine particularly adapted for the surface planing of elongated parts with loose particulate finishing media, in the form of a tub having an open top and upwardly-extending side walls and an arcuate bottom extending between said upwardly-extending side walls, vertically-extending front and back walls, said front and back walls extending vertically above said side walls, an internal flow diverter mounted internally of said chamber between the front and back walls thereof and located generally centrally of said chamber, the vertically-extending front and back walls providing a channel in which an elongated part can be positioned for contacting orbiting finishing media when said chamber and finishing media therein is vibrated to cause vibratory motion thereof and orbital motion of said finishing media around said internal flow diverter; such a chamber wherein said internal flow diverter is hollow; such a chamber wherein said internal flow diverter is generally cylindrical; such a chamber wherein said internal flow diverter is generally cylindrical with at least one protuberance on the surface thereof; such a chamber wherein said internal flow-diverter is adjustable for purposes of changing the flow diversion of finishing media by said internal flow diverter; and a plurality of such chambers disposed in side-by-side relationship, with side wall adjacent to side wall, and connected in series by connectors, said connectors spanning adjacent side walls, thereby forming a support for an elongated part to be finished; and such a plurality of chambers wherein said connectors also span adjacent front and back walls.

BRIEF DESCRIPTION OF THE INVENTION

The invention briefly involves the surface-planing of a part or workpiece, preferably an elongated part or workpiece, by exposure to vibrating and orbiting finishing material which is confined within a finishing chamber, usually have an arcuate bottom, and preferably having an internal flow diverter, the contact between the part or workpiece to be surface-planed and the finishing material taking place at the upper portion of the orbit of the said finishing media, which is also usually caused to orbit in a direction which corresponds to the direction of feed of said part and to the longitudinal direction of said part. The part can thereby be surface-planed without submergence in the finishing media and its direction of movement can be controlled by controlling the direction of orbital flow of the media. The vibratory means for imparting vibratory movement to the resiliently-mounted finishing chamber is preferably but not necessarily located within the internal flow diverter and the dimensions of the finishing chamber are preferably so designed as to create a channel between somewhat higher front and back walls for the movement of elongated parts or workpieces therebetween and somewhat shorter side walls for purposes of enabling the elongated part or workpiece to rest thereon during exposure to the surface-planing procedure. The said support and channel aspects of the apparatus of the invention are particularly valuable when extremely elongated parts are to be surface-planed and when a plurality of surface-planing devices according to the invention are arranged in side-by-side juxtaposition. The orbital motion in adjacent finishing chambers can either be in the same direction or in opposite directions, and direction of the orbital flow of the finishing media can be employed to control the movement of the part being surface-planed through the apparatus, whether it be a single unit or a plurality of surface-planing units connected in series. In some cases it is advantageous for purposes of creating a desired orbital flow to have a protuberance on the internal flow diverter, which may also be adjustable to create different flow diversions, and additional support means, such as in the form of rollers or the like, may sometimes advantageously be provided, optionally along with hold-down means to ensure adequate contact of the part being surface-planed with the top of the finishing media orbit, and such hold-down means may also take the form of rollers which may in some cases also advantageously be resiliently mounted. In any event, the object of the invention is the surface-planing of the part or workpiece without the necessity of submerging the same in the finishing media and this result is uniquely and advantageously accomplished according to the method of the invention, which is in turn advantageously conducted in the surface-planing apparatus of the present invention, which in turn is advantageously equipped with its unique finishing chamber which is particularly adapted for the surface-planing operation.

BRIEF DESCRIPTION OF THE DRAWINGS

The invention in its preferred embodiments is illustrated by the accompanying drawings in which:

FIG. 8 is a sectional view of another modification of a unit according to the present invention wherein the flow diverter is adjustable.

FIG. 9 is a sectional view taken on line 9—9 of FIG. 8.

FIG. 10 is a partial face view of the unit of FIG. 7 showing adjustment means for adjustment of the internal flow diverter and adjustment means for motor location.

DESCRIPTION OF THE PREFERRED EMBODIMENTS

Figure 1:
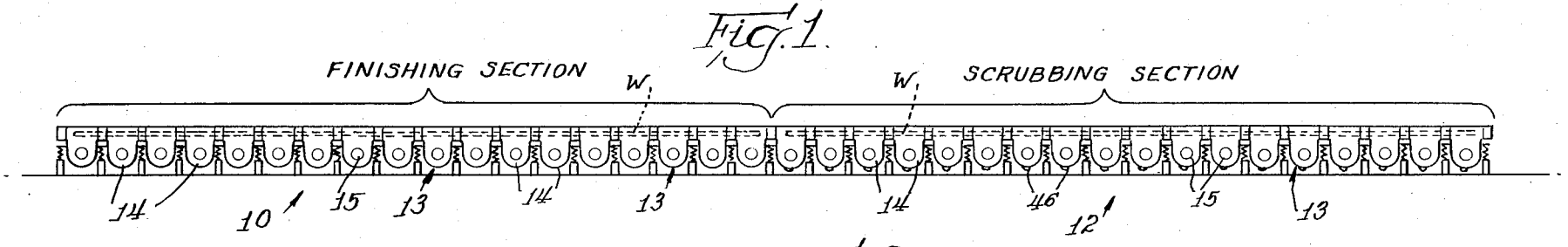
FIG. 1 is a side elevational view of a finishing and scrubbing machine according to the invention having eighteen finishing and eighteen scrubbing units, the scale being approximately one-tenth of an inch to one foot.

Reference is now made to the accompanying drawings for a better understanding of the invention, wherein all of the parts are numbered and wherein the same numbers are used to refer to corresponding parts throughout.

Referring to FIGS. 1–4, the embodiment illustrated comprises a plurality of individual units linearly arranged and comprising two sections, a finishing section 10 and a scrubbing section 12. Each of these sections comprises several vibratory surface-planing units 13, for example, eighteen (18) units on thirty-two inch centers, for a total of thirty-six units or a little over 100 feet for the entire facility, which is designed for the surface-planing of workpieces W approximately two (2) inches in total thickness by two (2) feet in width by forty-eight (48) feet in length. Such workpieces generally have a flat top and a longitudinal ribbed bottom and are produced either by molding or machining, usually the latter.

Figure 2:
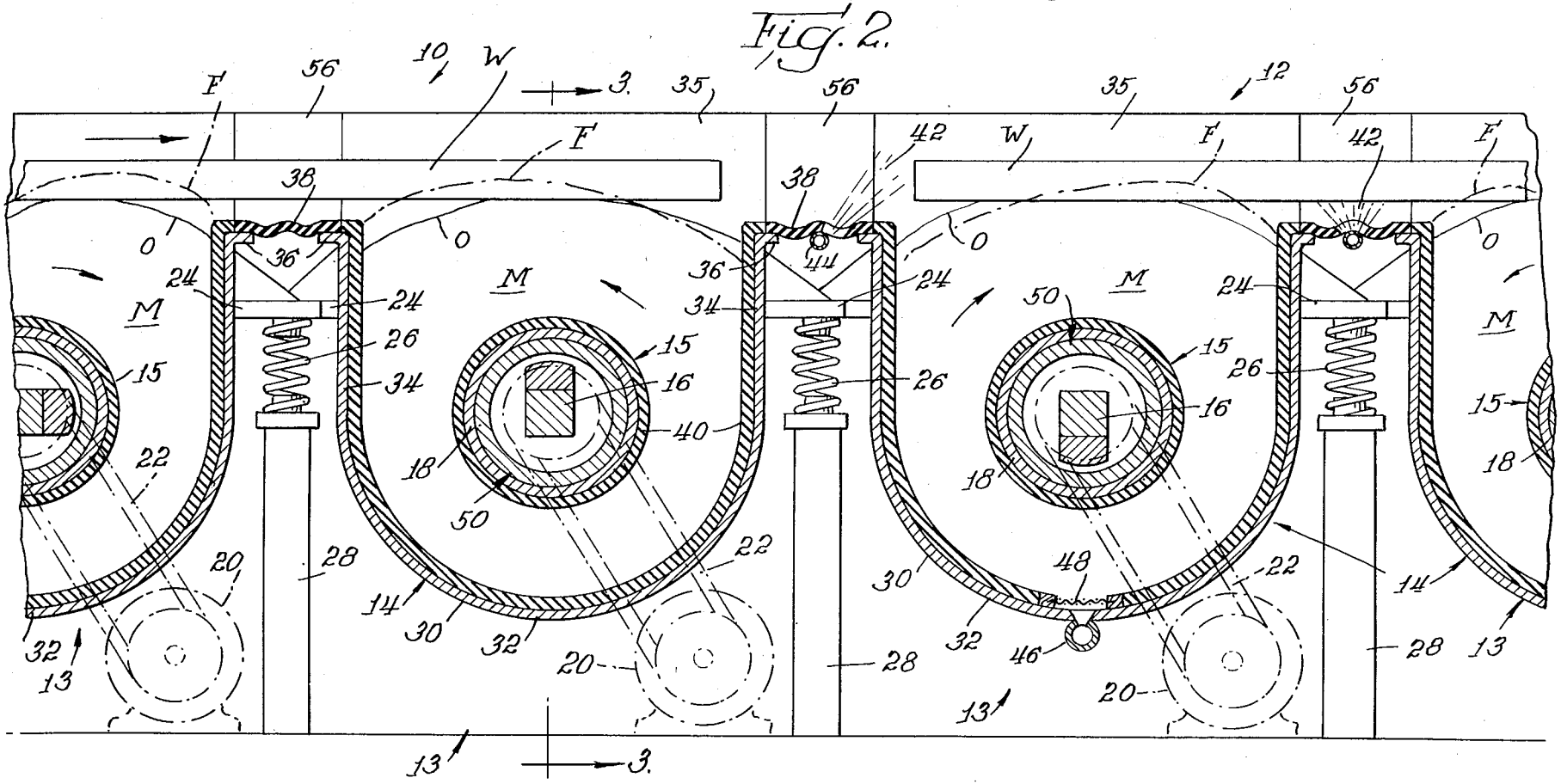
FIG. 2 is a central section of the middle portion of FIG. 1, showing at least one complete finishing unit and one complete scrubbing unit on approximate one-eighth scale, the distance from center to center of the units being approximately thirty-two inches.

As best seen in FIG. 2, each vibratory surface-planing unit 13 comprises a chamber in the form of vibratory tub 14, each of which tubs has an eccentric-weighted shaft 16 which is rotatably journaled or otherwise mounted for rotation within an internal flow diverter 15 by means of a centrally-located cylindrical collar 18 and driven by a reversible motor 20 by means of belt 22. Each such chamber or tub 14 has brackets 24 for resilient mounting by means of springs or elastomer 26, in turn supported by base or stands 28. Each chamber or tub 14 has an outer housing 30 comprising an arcuate bottom 32, upwardly extending side walls 34 and essentially vertical front and back walls 35, together with turned-out flanges 36 for the attachment of connecting boots 38. Said boots 38 join adjacent tubs to one another and may advantageously be of corrugated elastomeric material. The interiors of the chambers or tubs 14 are coated with elastomer 40, as is conventional in the art, and contain loose particulate finishing media M.

The media M employed in the scrubbing section 12 is employed together with a liquid additive 42 such as water or certain chemicals or solvents, depending on the material of construction of the workpiece W. Such additives are conventional in the art and are added through spray pipes 44 and thence through openings provided in boots 38. To accommodate excess liquid, drain 46, having a replaceable screen 48, is also provided in the units 13 of scrubbing section 12.

Since variable weights may be desirable in operation, eccentric-weighted shaft 16 is advantageously mounted in a cartridge-like unit 50, having enclosed bearings and seals 52, at front and back of the unit 13, and a pulley 54 on one end thereof to be driven by belt 22 from motor 20, the cartridge 50 being located within internal flow diverter 15.

Figure 4:
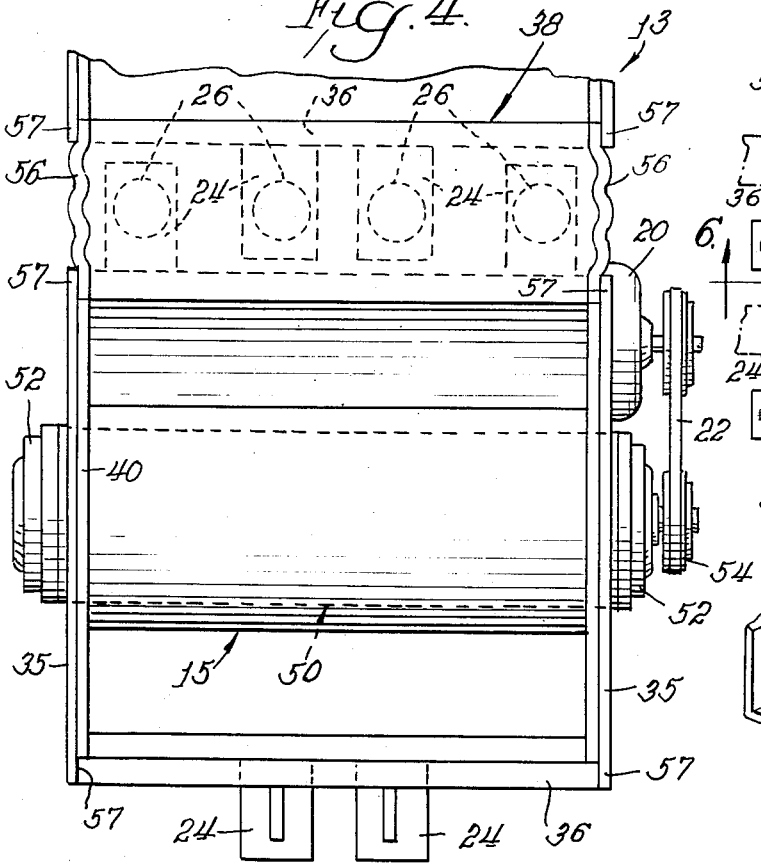
FIG. 4 is a top view of FIG. 3 with one boot removed to illustrate the staggered brackets employed for resilient mounting of the finishing chamber.

As best seen in FIG. 4, the mounting brackets 24 are staggered so that they overlap each other in a nesting relationship to enable resilient mounting means 26 from adjacent units 13 to line up and conserve space.

Vertical walls 56 of boots 38 are attached to front and back walls 57 of the upper part of the chamber or tub 14, whereas the horizontal sections of the boots are attached to flanges 36 as previously described.

Figure 5:
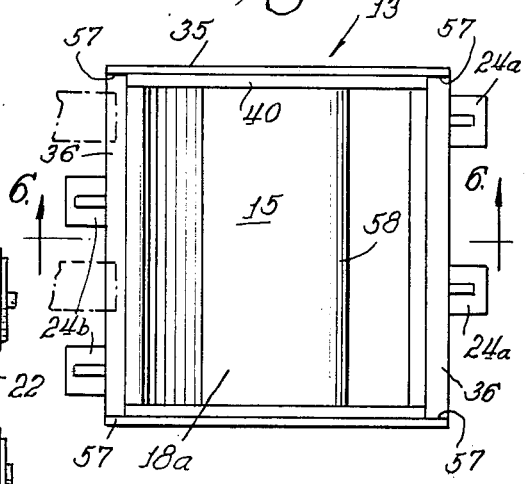
FIG. 5 is a top view of one unit of a modified form of the invention on a reduced scale showing an alternate staggering of the mounting brackets and embodying a central flow diverter having a protuberance on the surface thereof.
Figure 7:
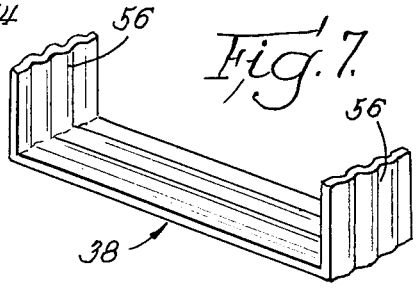
FIG. 7 is a perspective view of the boot connecting two units or finishing chambers according to the invention.

FIG. 5 is a top view showing a modified form of finishing unit according to the invention, but also shows an alternate staggering of brackets 24, in which embodiment there is no necessity of producing left-hand and right-hand units, as in the case of the units of FIG. 4, for example. In this case, if the entire unit is rotated 180°, the bracket **24*a* is then in the position shown at 24*b***.

Figure 3:
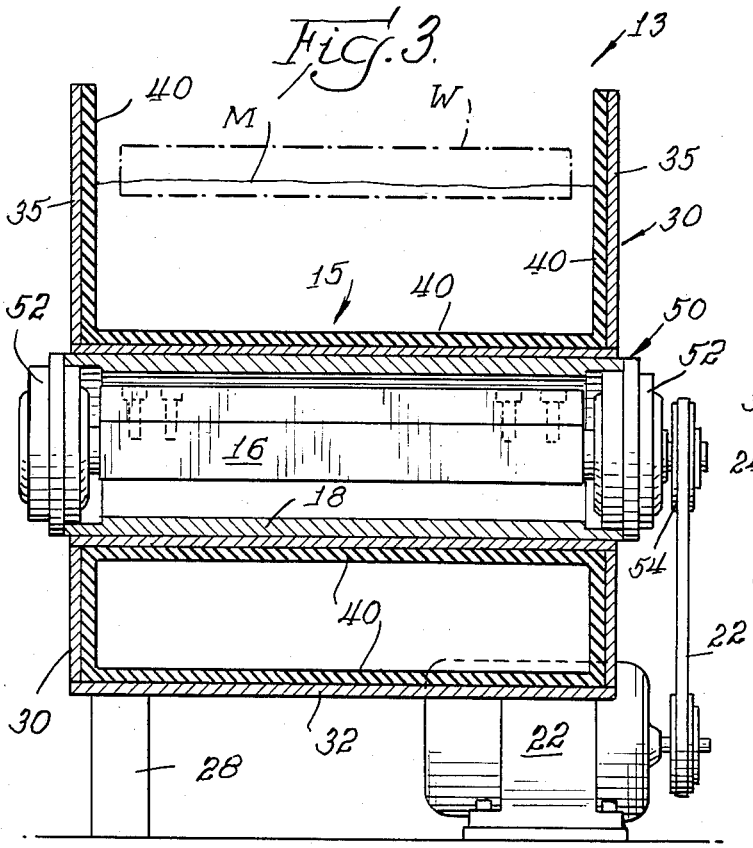
FIG. 3 is a section taken along line 3—3 of FIG. 2.
Figure 6:
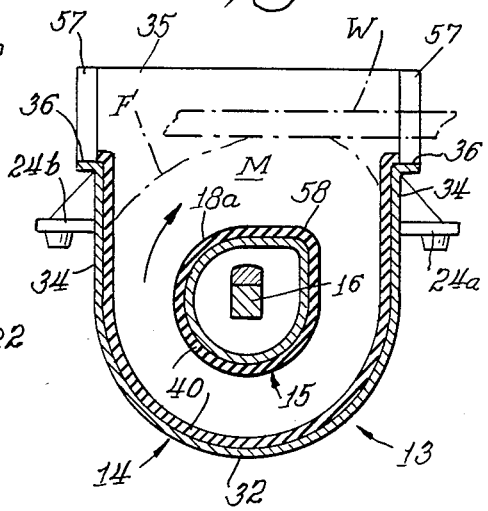
FIG. 6 is a cross-sectional view of the unit of FIG. 5 taken along line 6—6 of FIG. 5.

The cross-sectional view of FIG. 6, taken from FIG. 5, shows a central internal flow-diverter 15 which, while generally cylindrical in the apparatus of FIGS. 3 and 4, now is cylindrical only approximately three-quarters of the way around and then terminates in a right-angle hump or protuberance 58, which forces the loose particulate finishing media to rise up to the right as shown in FIG. 6. As shown, collar 18*a* has the same external configuration. This is particularly advantageous in effecting a higher orbit to the right of the chamber and for advancing the workpiece W to the right when desired.

Referring now to FIGS. 8, 9, and 10, in order to facilitate and control the height of the orbit of the media, an adjustable internal flow diverter 15 may be provided, and may advantageously take the form shown in FIGS. 8, 9, and 10, in which an embodiment is shown wherein the internal flow diverter 15 is provided with an adjustable gate 60, said gate also being covered by elastomer 40. It should be understood that the direction of the flow F, particularly up a rise portion of the finishing chamber, controls the holding or the advancement of a workpiece W and also that the exact configuration of the internal flow diverter 15 also controls the height of the orbiting finishing media. Thus, with an even number of finishing chambers, one-half flowing clockwise and one-half flowing counterclockwise, a relatively static condition is created, which is advantageous when a considerable period or dwell time is required for planing of a particular workpiece whereafter, when the desired degree of planing has been effected, the workpiece can be advanced by reversing some of the motors and, accordingly, the direction of flow of the media around the internal flow diverter in some of the chambers 14.

For purposes of illustration, dot-dash lines, illustrating the flow F, are shown in FIGS. 2, 6, and 8. The position of the orbiting media is indicated in FIGS. 2 and 8 at F with the motor running and the machine in operation and at O with the motor off and the machine non operational.

For adjustability of the internal flow diverter 15, as by means of gate 60, a gate control mechanism 62 is provided, which comprises a handle 64 having a spring-biased latch 66, which latch locks into notches 68 in raised segment 70, as illustrated in FIGS. 9 and 10.

In this embodiment the employment of a hydraulic and/or pancake motor 72 has also been illustrated, for purposes of driving the eccentrically-weighted shaft 16, which motor 72 is mounted outside bearing members 52 for rotation of the eccentrically-weighted shaft 16 inside the hollow internal flow diverter 15. Also illustrated are adjustment holes 74 for adjusting the location of said motor bearings 52, seal units, and weighted shaft 16 with respect to the finishing chamber 14, thereby providing a vertical adjustment for the vibratory drive mechanism with respect to said chamber. In such an arrangement as shown, the hollow central portion 76 of the internal flow diverter 15 is elongated vertically to permit adjustment upwardly and downwardly of the vibratory unit, whereas the upper portion of the internal flow diverter is slanted, as at 78, to allow for adjustment of the outer contour thereof by means of adjustable gate 60.

The versatility of this type of vibratory surface-planing machine and the finishing chamber utilized therein, which is open top, with vertically-rotating or vertically-orbiting media therein, with direction of orbit in the direction of feed or the longitudinal dimension of the part, as opposed to an open top finishing chamber wherein the rotation or orbit of the media is in a direction normal to the direction of feed or normal to the longitudinal dimension of the part, as has been common in previous finishing devices, and in general the advantages and versatility of this type of apparatus, chamber, and procedure compared to procedures wherein the part or workpiece to be finished must be submerged in the media rather than merely exposed, at a surface thereof, to the upper portion (as opposed to a lower portion) of the finishing media orbit, is further illustrated in FIGS. 11–15.

Figure 11:
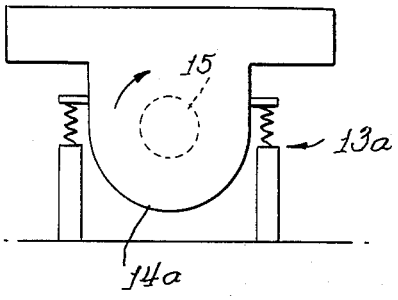
FIG. 11 is a diagramatic face view of one unit according to the invention.

In FIG. 11 is illustrated a single unit machine 13*a* having a single finishing chamber 14*a* wherein a workpiece may be surface-planed by hand feeding or by advancement while hanging from an overhead tramrail.

Figure 12:
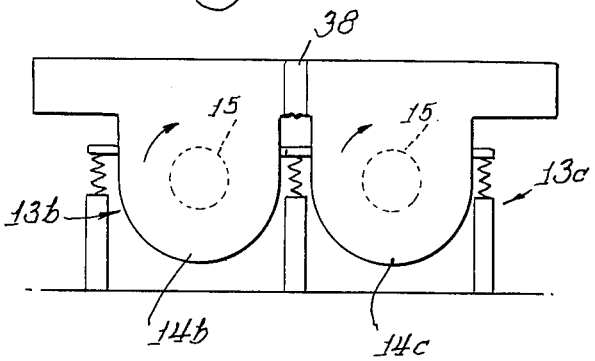
FIG. 12 is a diagramatic face view of a two-unit machine according to the invention.

FIG. 12 shows a two-unit machine having units 13*b* and 13*c* with finishing chambers 14*b* and 14*c*, wherein different types of media, such as finishing and polishing media, can be employed.

Figure 13:
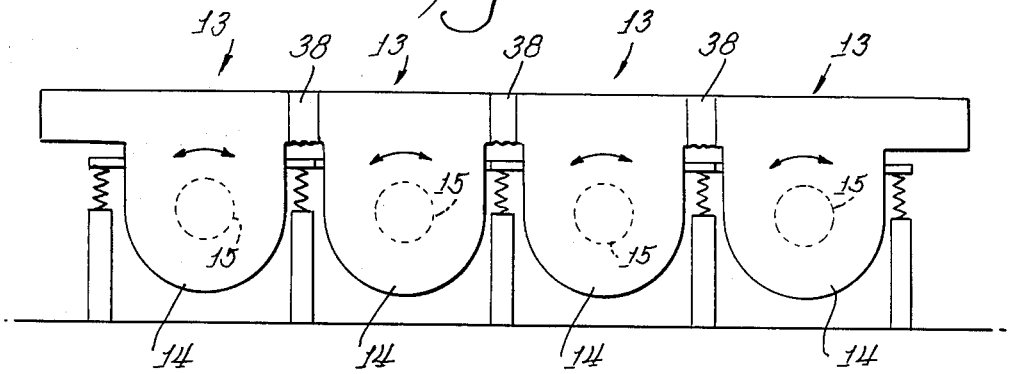
FIG. 13 is a diagramatic face view of four units according to the invention, two for finishing and two for scrubbing.

In FIG. 13 is shown a multiple-unit arrangement having a plurality of units 13 and finishing chambers 14, such arrangement being particularly suitable for workpiece lengths of ten to twelve feet.

Figure 15:
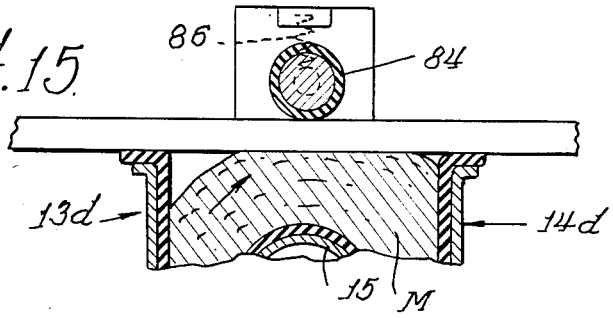
FIG. 15 is a detail of the hold-down means of FIG. 14.
Figure 14:
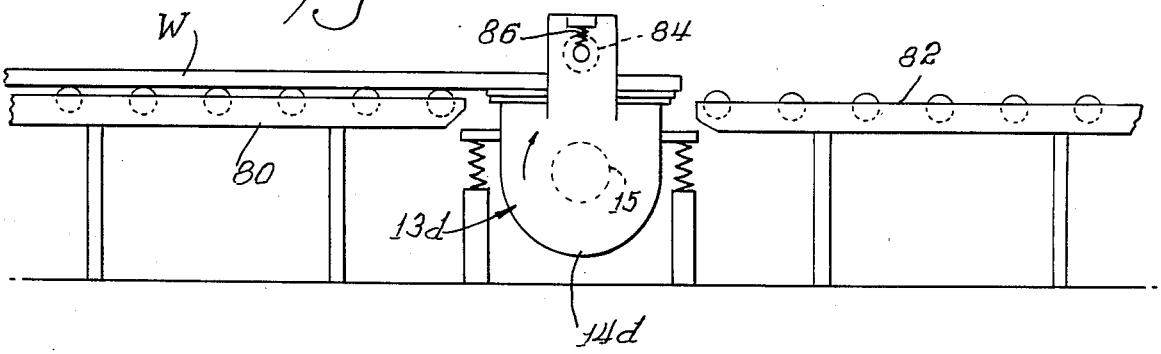
FIG. 14 is a diagramatic face view of another embodiment of the invention including conveyor inlet and outlet means and hold-down means.

In FIGS. 14 and 15 is shown an embodiment of the invention having a conveyor 80 for bringing the workpiece W across the top of the finishing chamber 14*d* of unit 13*d* and on to an exit conveyor 82. In the case of lightweight workpieces, a hold-down means, such as elastomeric-coated roller 84, is optionally provided, including a downward spring-biasing means 86 for resiliently mounting of the hold-down means, the said spring-biasing means 86 as shown being mounted on extensions coming up from the outside of the front and back walls of the tub 14*d*.

In an alternative embodiment, the chamber or tub 14 may have walls of the same or approximately the same height on all four sides with a square funnel-type boot extending all the way around to keep the media from spilling out of the machine when the vibratory means is activated to cause vibration and orbital motion of the loose particulate finishing media therein. The side edges of such a square funnel-type boot can be made to abut or overlap for purposes of connecting the machine units and providing support for the elongated workpiece, particularly when the same is not floating upon the upper portion of the finishing media orbit, as when the vibratory mechanism is inactive. Such a funnel-type boot has the advantage of isolating the vibration of the machine from the workpiece, and may if desired be supported by an angle-iron frame around the square funnel-type boot on all or some of the sides of the individual finishing machine chamber.

As a still alternative embodiment, the boots between the side walls of adjacent machine units can be of an inverted V configuration, thereby ensuring that the media returns to the respective finishing machine chambers in addition to providing support for the elongated workpiece being finished, particularly when the machine is not in operation so that it can rest or float upon the upper portion of the orbiting finishing material.

Of course, as is well known in the art, operation of the vibratory unit 50 or 72 in a clockwise manner imparts a counterclockwise rotation to the body of finishing media M, whereas operation of the vibratory unit in a counterclockwise manner imparts a clockwise rotation to the body of finishing media M, thereby providing a ready and simple means of controlling the direction of the finishing media orbit either in a clockwise or counterclockwise direction.

As the units are arranged in sequence in FIG. 1, the orbital motion of the finishing media in some chambers of the series is in a clockwise direction, whereas in other finishing chambers of the series the rotation is in a counterclockwise manner. As shown in FIG. 2, the last unit in the finishing section and the first unit in the scrubbing section contain media rotating in a counterclockwise and in a clockwise direction, respectively. Since, when the vibratory mechanism is turned off, the level of the finishing media M in the chamber 14 assumes a lower level O than when the vibratory mechanism is actuated, the workpiece W then rests generally upon the relatively horizontal sections of boots 38 whereas, with the vibratory mechanism actuated, the orbital flow F of the finishing media M causes the top portion thereof to assume a position of relatively greater height than the horizontal portions of the boots 38, so that in fact the workpiece W floats upon or is carried by the upper portion of the orbit of the rotating and vibrating finishing media. This is true when an individual unit of the machine is employed and in operation. It goes without saying that, when an equal number of units contain bodies of finishing media rotating in a clockwise and counterclockwise direction, and all are in operation, the workpiece assumes a static position and neither advances nor retreats. When the finishing media in all of the units of a sequential arrangement is orbiting in the same direction, and all are operational, the workpiece travels in the direction of orbital rotation. By adjustment of the direction of rotation of the finishing media orbit, so that some are orbiting in a counterclockwise manner and others in a clockwise manner, or vice versa, the workpiece can be caused to assume a predetermined dwell time in the apparatus, and/or to proceed in its longitudinal direction either toward an exit at the last machine in the series or back toward its point of entry into the operation, and this is readily accomplished because the direction of rotation of the finishing media in the individual units and chambers is ordinarily either in the longitudinal direction of the workpiece, and in the direction of feed, or in just the opposite direction.

The relative positions of the finishing media M in the various finishing chambers or tubs 14 when the vibratory mechanism is not activated is shown in FIGS. 2 and 8 by the letter O, and in FIGS. 2 and 8 when the machine is in operation by the letter F. FIG. 6 moreover shows the flow F of media M to the right in the finishing chamber 14 of FIG. 6 with an internal flow diverter 15 having a right-hand protuberance, creating a bulge at the top surface of the orbit to the right of center, of advantage when it is desired to increase the height of the orbit more than usual, while employing the same amount of finishing media, or when desiring to float a workpiece W to the right.

Referring to FIGS. 11–15, FIG. 11 shows clockwise orbital motion, FIG. 12 shows two units with clockwise orbital motion, either or both of which could be reversed by reversal of the direction of the vibratory unit to counterclockwise, FIG. 13 shows orbital motion of four units in either direction, because the direction of rotation is entirely controlled by the direction of rotation of the vibratory unit so that the finishing media in all or a part of the units shown in FIG. 13 can be caused to rotate in either a clockwise or a counterclockwise direction depending upon the dwell time desired for the workpiece in the series. The single unit shown in FIGS. 14 and 15 contains finishing media which, as shown, orbits in a clockwise direction, but it will be readily understood that, depending upon the intended dwell time, the type of part being finished, the type of media being employed, whether surface-planing or scrubbing or both are desired, and the exact type of finish desired to be imparted, the orbital rotation can be in either direction or in both directions, and that the installation will require a greater or lesser extent of floor space and in general a smaller or a larger number of units for the intended operation.

In addition, besides hand feeding, roller-feeding, and overhead tramway feeding, as examples, vibratory conveyors may also be employed for feeding when convenient, and these generally employ a trough vibrated by a vibratory motor or similar means, said trough being supported by leaf springs which are anchored in a base, the vibratory means causing the trough to move forwardly and upwardly in one position and then quickly downwardly and rearwardly in the reverse position. Such vibratory conveyors or feeding devices are well known in the art and may, in certain circumstances, be of value in assisting the motion of an elongated part through or to a unit or plurality of units of finishing machines of the type here involved, particularly when it is not desired to depend or depend entirely upon the control of the direction of finishing media orbit for control of the direction of longitudinal movement of the part or workpiece, that is, solely by controlling the direction of orbital flow of the media in the chamber or chambers involved. In such case where controlled advancement indpendent of the direction of finishing media orbit is desired, an overhead crane or tramway may also be employed, but with its normal attendant inconvenience, additional space, and additional capital investment requirements.

In operation, the elongated part or workpiece is fed by hand or otherwise into a single surface-planing device according to the invention, or into a plurality of the same arranged in series with side wall to side wall and ordinarily connected by connectors. Preferably, but not necessarily, the front and back walls of the individual finishing chambers are higher than the side walls, so as to provide a channel within which the elongated part or workpiece can be advanced. The connectors between successive chamber side walls are generally horizontal with front and back vertical walls, so as to provide a continuous channel and also provide a support upon which the part or workpiece being finished may rest, especially when one or more units are not in operation. As already pointed out, the horizontal section of the connector may have the configuration of an inverted V, for purposes of ensuring minimum spillage and the direction of the finishing media back into the individual finishing chambers and to provide increased resiliency when used as a support for the part or workpiece being finished, or take other forms. The media contained in the finishing chamber or series of finishing chambers is preselected, depending upon the part being finished and the intended surface finish to be imparted thereto, and loose particulate finishing media for imparting all types of finishes is well known in the art. The part to be finished "floats" upon the upper portion of the orbiting finishing media when the vibratory mechanism is activated, and the dwell time of the part or workpiece within the unit and installation is controlled by controlling the direction of orbit of the finishing media in the various chambers involved. When the direction of the orbit corresponds to the longitudinal direction of the part or workpiece and the direction of feed, or the reverse, the part advances through a unit or battery of units sporadically or at a predetermined rate, or advances and then retreats, or advances from beginning to end and then reverses itself and returns to the point of beginning, or whatever programming combination may be considered most desirable from the standpoint of the operator and the particular type of surface-planing and finishing desired ultimately to be produced. When the unit or units are turned off, the vibratory motion and orbital motion of the finishing media ceases, and the top portion of the finishing media orbit then assumes a position of repose which, because generally lower than the highest point of the orbit during vibration and orbital motion, and also because it is generally lower than the height of the side walls and/or connectors, in turn permits the workpiece W to assume a position of repose supported by the side walls of the finishing machine unit or units and the horizontal portion of any connectors involved, as well as, of course, any roller, conveyor, or feed assembly which may be involved, as long as the part or workpiece is not supported from above.

When the part or workpiece has been finished to a desired degree, it may be passed along by floatation upon the top portion of the orbiting finishing media to a scrubbing section or apparatus, which may comprise either a single unit or an assembly of units 12 as shown in FIG. 1. Thereafter, the part or workpiece may be passed in the same manner out of the assembly with the desired degree of surface-planing and/or finishing and/or scrubbing and/or polishing having been performed thereon. Alternatively, the scrubbing section may be omitted. The exact type of finishing and/or polishing and/or cleaning and/or scrubbing material contained in each finishing chamber of each unit which may be involved is entirely up to the operator and depends upon the intended result. The exact type of surface finishing here involved is not of consequence, but the term "surface-planing" has been used herein and in the claims inasmuch as the operation involved according to the present invention essentially involves the treatment of only a single surface of a part at one time, i.e., the bottom surface or the top surface, or both sequentially, and not all surfaces of the part simultaneously, as is common with submergence of a part or workpiece in the finishing media employed according to the prior art, the most acceptable of which is, according to present understanding, the "Sparatron", which is the device of U.S. Pat. No. 3,624,970.

It should be obvious to one skilled in the art that, whereas the vibratory units have been shown as motor-driven vibratory shafts or vibratory cartridges, any other similar or equivalent means for vibrating the finishing chambers of the finishing machines of the present invention can be employed, and that such means can be run independently at the same or different speeds and amplitudes, as well as direction of rotation, employing either a single eccentric weight on a shaft or at one end of a shaft or both ends of a shaft, and with these weights being set either in or out of phase, and according to which settings and structures the finishing machine and method and the finishing media within the finishing chamber will all assume different modes in accord with the various selections and settings of the vibratory means employed, thus making possible the production of innumerable relative settings and the importation of innumerable different operating modes to the apparatus of the invention and to the finishing media therein. Although out-of-phase settings of eccentric weights at opposite ends of the shaft of a vibratory motor, or of an independently mounted shaft, may be employed if desired, in-phase settings or a single weight on a shaft, as shown in the drawings, are preferred, in view of the fact that there is no necessity for out-of-phase weights or settings because the orbital motion of the finishing media according to the present invention should ordinarily at least generally coincide with the longitudinal dimension of the part to be finished and with the direction of feed, or be directly opposite thereto. This is, however, not to say that out of phase weights or settings cannot be employed, so long as the general thrust of the orbital motion of the finishing media created in the individual finishing chamber or in the sequential arrangement of finishing chambers is generally coincident with the longitudinal direction of the part or workpiece to be finished and with the direction of feed thereof, or approximately one hundred and eighty degrees opposed thereto, for the accomplishment of what may be considered universally acceptable surface-planing results. In this respect, it can even be contemplated that a single installation might contain different chambers with orbital rotation settings for direction of feed, slightly out of phase in one direction, slightly out of phase in the other direction, and normal to direction of feed, depending upon the part to be finished and the program desired, but in which at least one finishing chamber must have the finishing media orbital rotation at least generally in its longitudinal direction and/or the direction of feed.

It should also be pointed out that the connector 38 can be of any suitable material of an elastomeric or other nature which provides resiliency and thereby a resilient association between the side walls of adjacent finishing chambers and that, further, any resilient connection can be employed so long as upwardly-extending side walls of the finishing chamber are connected to but vibrate independently of the adjacent side walls of the next finishing unit and finishing chamber in the installation sequence. Although connectors can even be eliminated, excessive spillage and waste usually results.

Moreover, although as shown in the drawings the vibratory means are preferably mounted in a cartridge within the internal flow diverter, driven by a universal motor or by a pancake or hydraulic motor located centrally of the finishing chamber, it should be apparent that the vibratory means can be mounted at the bottom of the finishing chamber or at any point on a bottom-forming portion of a wall constituting a part of the bottom of the finishing chamber, or on a side thereof, or at an upper or lower or off-center position, as may prove to be convenient or desirable in a particular case, provided only that the direction of rotation of the eccentric, and therefore the vibrations imparted to the finishing chamber thereby, can be directed either generally coincident with the longitudinal dimension of the part or workpiece being finished or diametrically opposed thereto.

Although the cross-section of the finishing chamber wall has been described herein as being arcuate or essentially arcuate, and particularly and preferably as being a cross-section essentially that of semi-circle or portion thereof, it is to be understood that it is not essential that such a defining wall of the finishing chamber be arcuate or semi-circular in the precise sense of the term.

It is only necessary, when the bottom of the finishing chamber is arcuate or semi-circular, that it be insufficiently cornered so as to prevent the free flow of finishing media in and around the interior of the particular section of the finishing chamber involved. For example, the bottom of the finishing chamber may be generally arcuate or semi-circular in cross section, including decagonal, octagonal, hexagonal, or pentagonal, or may have any other somewhat cornered cross-section which does not detract from a general arcuate or semi-circular nature and which, in partcular, does not interfere with the flow of media within the interior of the finishing chamber. Although a truly arcuate or semi-circular cross-section is preferred, other generally arcuate and generally semi-circular cross sections may be imparted to the finishing chamber bottom with equal or only somewhat reduced efficiency, as will be apparent to one skilled in the art.

It is also to be understood that the term "finishing media" is used generally herein to designate materials which are loose and particulate and which are used to impart all types of finishes, including those finishes imparted with abrading material as well as with polishing material and that polishing, abrading, deburring, edge-breaking, buffing, burnishing, scrubbing, and the like, are as usual only species of finishing, which in the present case is the type of operation which is carried out under the heading "surface planing". The term "finishing media", as used herein, is also intended to include all such materials which serve as loose, particulate, and solid finishing materials of the type presently employed in the trade and others of a similar nature, whether natural or synthetic, including stone, porcelain, abrasive-filled clays, plastics, ceramics, wood, leather, cobmeal, or the like, and in any suitable shape or form as may be employed for the surface refinement and/or deburring of parts or workpieces, which are usually of metal or plastic, but sometimes of wood or the like, but which in the present case are generally solid elongated parts or workpieces and which are subjected to the surface-planing operation described herein for purposes of finishing a surface thereof, or both surfaces thereof sequentially, but without the general submergence of the part or workpiece in the finishing media as has previously been the practice of the art.

Thus it is seen that, according to the present invention, a novel surface-planing machine, unique finishing chambers particularly adapted for use therein, and a novel method for the vibratory surface-planing of an elongated part or workpiece, which clearly avoid all of the aforementioned shortcomings of the prior art, have been provided.

it is to be understood that the invention is not to be limited to the exact details of construction, operation, or exact materials or embodiments shown and described, as obvious modifications and equivalents will be apparent to one skilled in the art, and the invention is therefore to be limited only by the full scope of the appended claims.

I claim:

1. A finishing machine having a finishing chamber for the vibratory surface-planing of an elongated part or workpiece, which is longer than the width of said chamber from side to side thereof, by feeding said elongated part to said machine from a direction normal to the side walls of the said finishing chamber thereof and in a direction parallel to the front and back walls of said chamber, which comprises means for causing loose particulate finishing media to undergo vibration and orbital motion in said finishing chamber said finishing chamber having upwardly-extending substantially vertical front and rear walls and side walls, connected by an arcuate bottom between said side walls, and an open top to produce an orbit, having an upper portion and a lower portion, in a direction normal to said side walls of said finishing chamber and parallel to said front and rear walls of said chamber and in a direction corresponding to the longitudinal dimension of said part, means for causing the upper portion of said orbit to extend vertically at least to the open top of said chamber, and means for exposing the surface of the elongated part or workpiece to be finished to said orbiting finishing media without submergence in said media by positioning said surface in contact with said orbiting finishing media at the upper portion of its orbit.

2. The machine of claim 1, including means for causing the upper portion of said orbit to extend above at least the two side walls of said chamber.

3. The machine of claim 1, including means for controlling the movement of the part or workpiece along its longitudinal dimension by controlling the direction of orbital flow of the media in the chamber parallel to said front and rear walls of said chamber.

4. The machine of claim 1, including means for maintaining a plurality of bodies of media in series and for maintaining different directions of orbital flow, parallel to said front and rear walls of said chamber, in different bodies of media.

5. A finishing machine, comprising a finishing chamber having an open top and substantially vertical front and rear walls and side walls connected by an arcuate bottom, for the vibratory surface-planing of an elongated part having a longitudinal and a transverse dimension and which part is longer than the width of said chamber from side to side thereof, comprising means providing a body of loose particulate finishing media, means for imparting orbital flow to said media from the bottom to the top thereof between said front and rear walls to produce an orbit having a top portion and a bottom portion, means for causing said media to orbit in a direction parallel to said front and rear walls and corresponding to the longitudinal dimension of said part, and means for subjecting a surface of said elongated part to the action of said media at the top portion of said orbit without submergence thereof in said media and across said open top in contact with said orbiting media in the direction of orbital movement thereof.

6. The machine of claim 5, including means for causing said media to orbit in a direction corresponding to the direction of feed of said elongated part.

7. The machine of claim 5, including means for providing a plurality of bodies of media sequentially, means for imparting orbital motion to said media in at least one of said bodies parallel to said chamber front and rear walls in a first direction corresponding to the longitudinal dimension of said part, and means for imparting orbital motion to said media in at least one of said bodies of finishing media parallel to said chamber front and rear walls and in a direction corresponding to the longitudinal dimension of said part but opposite to said first direction.

8. The machine of claim 5, including means for providing a plurality of bodies of media sequentially, means for imparting orbital motion to said media parallel to said front and rear walls in at least one of said bodies and in a direction corresponding to the direction of feed of said part, and means for imparting orbital motion to said media parallel to said front and rear walls in at least one of said bodies of finishing media in a direction opposite to the direction of feed of said part.

9. A vibratory finishing machine having a finishing chamber particularly adapted for the surface planing of elongated parts which are longer than the side-to-side width of said chamber with loose particulate finishing media without submergence therein comprising said chamber in the form of a tub having an open top and upwardly-extending side walls extending to the lowest edge of said open top and an arcuate bottom extending between said upwardly-extending side walls, vertically-extending front and back walls, an internal flow diverter mounted internally of said chamber between the front and back walls thereof and located generally centrally of said chamber, a fixed base, means on said fixed base for resilient mounting of said chamber, and vibratory means to impart orbital motion to said chamber and to loose particulate finishing media, when deposited therein, around said internal flow diverter up to at least said open top and between said vertically-extending front and back walls of said chamber and in a direction parallel thereto, the upwardly-extending side walls providing support means upon which an elongated part can be positioned for contacting orbiting finishing media when said finishing media is vibrated to cause orbital motion thereof, and sufficient finishing media in said tub to create said orbit up to at least said open top.

10. A vibratory finishing machine having a finishing chamber particularly adapted for the surface planing of elongated parts which are longer than the side-to-side width of said chamber with loose particulate finishing media without submergence therein comprising said chamber in the form of a tub having an open top and upwardly-extending side walls and an arcuate bottom extending between said upwardly-extending side walls, vertically-extending front and back walls, said front and back walls extending vertically above said side walls, an internal flow diverter mounted internally of said chamber between the front and back walls thereof and located generally centrally of said chamber, a fixed base, means on said fixed base for resilient mounting of said chamber, and vibratory means to impart orbital motion to said chamber and to loose particulate finishing media, when deposited therein, around said internal flow diverter and between said vertically-extending front and back walls of said chamber and in a direction parallel to said front and back walls of said chamber, the vertically-extending front and back walls providing a channel in which an elongated part can be positioned for contacting orbiting finishing media without submergence therein when said finishing media is vibrated to cause orbital motion thereof up to said open top of said chamber and parallel to said front and back walls.

11. The machine of claim 10, wherein said internal flow diverter is hollow.

12. The machine of claim 10, wherein said internal flow diverter is generally cylindrical.

13. The machine of claim 10, wherein said internal flow diverter is generally cylindrical with at least one protuberance on the surface thereof.

14. The machine of claim 10, wherein said internal flow-diverter is adjustable for purposes of changing the flow diversion of finishing media by said internal flow diverter.

15. The machine of claim 10, wherein said vibratory means comprises a shaft journalled in the front and back walls of said chamber carrying an eccentric weight, and means for rotatably driving said shaft.

16. The machine of claim 15, including external pulley means and belt and motor means for driving said vibratory means.

17. The machine of claim 15, wherein said internal flow diverter is hollow and wherein said shaft is located interior of said hollow internal flow diverter.

18. A vibratory finishing machine particularly adapted for the surface planing of elongated parts with loose particulate finishing media comprising a chamber in the form of a tub having an open top and upwardly-extending side walls and an arcuate bottom extending between said upwardly-extending side walls, vertically-extending front and back walls, said front and back walls extending vertically above said side walls, an internal flow diverter mounted internally of said chamber between the front and back walls thereof and located generally centrally of said chamber, a fixed base, means on said fixed base for resilient mounting of said chamber, and vibratory means to impart orbital motion to said chamber and to loose particulate finishing media, when deposited therein, around said internal flow diverter and between said vertically-extending front and back walls of said chamber, the vertically-extending front and back walls providing a channel in which an elongated part can be positioned for contacting orbiting finishing media when said finishing media is vibrated to cause orbital motion thereof, wherein a plurality of said machines are disposed in side-by-side relationship, with side wall adjacent to side wall, and are connected in series by connectors, said connectors spanning adjacent side walls.

19. The machine of claim 18, wherein said connectors also span adjacent front and back walls.

20. The machine of claim 18, wherein said connectors form a support for an elongated part to be finished.

21. A vibratory finishing machine particularly adapted for the surface planing of elongated parts with loose particulate finishing media comprising a chamber in the form of a tub having an open top and upwardly-extending side walls and an arcuate bottom extending between said upwardly-extending side walls, vertically-extending front and back walls, said front and back walls extending vertically above said side walls, an internal flow diverter mounted internally of said chamber between the front and back walls thereof and located generally centrally of said chamber, a fixed base, means on said fixed base for resilient mounting of said chamber, and vibratory means to impart orbital motion to said chamber and to loose particulate finishing media, when deposited therein, around said internal flow diverter and between said vertically-extending front and back walls of said chamber, the vertically-extending front and back walls providing a channel in which an elongated part can be positioned for contacting orbiting finishing media, when said finishing media is vibrated to cause orbital motion thereof, and parallel to said front and back walls, wherein a plurality of said machines are connected in series, with elastomeric connectors or boots between adjacent machines, said connectors extending generally horizontally between adjacent side walls of adjacent machines and generally vertically between adjacent front and back walls of adjacent machines.

22. The machine of claim 18, wherein the resilient mounting means on the respective bases of adjacent machines are staggered so as to permit location of said machines in close proximity to each other.

23. The machine of claim 18, wherein the connectors connecting said machines span the respective side walls of adjacent machines and comprise substantially horizontal sections at the level of adjacent side walls of adjacent machines and essentially vertical walls which extend above the adjacent side walls of adjacent machines.

24. The machine of claim 18, wherein the connectors have essentially vertical walls which are aligned with the vertical front and back walls to form a continuous channel in which an elongated part can be positioned.

25. The machine of claim 18, wherein the connectors connecting said machines have a vertical section extending between adjacent vertical front and back walls of adjacent machines to act as a guide for the elongated part being finished and as a dike to prevent finishing media from spilling outside of adjacent chambers between adjacent machines.

26. The machine of claim 23, wherein said essentially vertical walls extend essentially vertically to a height which is substantially the same as the height of the adjacent chamber front and back walls.

27. The machine of claim 18, wherein different machines included in said plurality of machines include means for imparting vibrational orbital motion to different chambers in different directions.

28. The machine of claim 27, wherein said vibratory means comprises a shaft journalled in the front and back walls of said chamber carrying an eccentric weight, and means for rotatably driving said shaft.

29. The machine of claim 28, including external pulley means and belt and motor means for driving said vibratory means.

30. The machine of claim 1, including hold-down means for holding said surface of said part or workpiece to be finished in contact with said finishing media.

31. The machine of claim 30, wherein said hold-down means comprises a roller.

32. The machine of claim 31, wherein said roller is resiliently mounted.

33. A method for the vibratory surface-planing of an elongated part or workpiece which comprises the step of causing loose particulate finishing media to undergo orbital motion in a confining chamber having substantially vertical front and rear walls and side walls connected by an arcuate bottom and an open top to produce an orbit, having a direction parallel to said front and rear walls and a direction corresponding to the longitudinal dimension of said part, having an upper portion and a lower portion, causing the upper portion of said orbit to extend at least to the open top of said chamber, and exposing the surface of an elongated part or workpiece to be finished, and which part or workpiece is longer than the side-to-side width of said chamber, to said orbiting finishing material without submergence in said media by positioning said surface in contact with said orbiting finishing media at the upper portion of its orbit.

34. The method of claim 33, wherein the upper portion of said orbit is caused to extend above at least the two side walls of said chamber.

35. The method of claim 34, including the step of floating the part or workpiece on a portion of the media at the upper portion of the orbital flow thereof.

36. The method of claim 35, including the step of controlling the direction of longitudinal movement of the part or workpiece by controlling the direction of orbital flow of the media parallel to said front and rear chamber walls.

37. The method of claim 35, wherein a plurality of bodies of media are provided in series and including the step of maintaining different directions of orbital flow parallel to said front and rear chamber walls in different bodies of media.

38. A method of vibratory surface-planing of an elongated part having a longitudinal and a transverse dimension comprising the steps of providing a body of loose particulate finishing media, imparting orbital flow to said media from the bottom to the top thereof between substantially vertical walls to produce an orbit having a top portion and a bottom portion and parallel to said substantially vertical walls, and subjecting a surface of said elongated part to the action of said media at the top portion of said orbit thereof without submergence of said part in said media, the said media being caused to orbit in a direction corresponding to the longitudinal dimension of said part.

39. The method of claim 38, wherein said part is fed in the direction of orbit or opposite thereto and wherein said media is caused to orbit in a direction corresponding to the direction of feed of said elongated part or opposite thereto.

40. The method of claim 38, wherein a plurality of bodies of media are provided sequentially and wherein the orbital motion imparted to said media in at least one of said bodies is in a first direction corresponding to the longitudinal dimension of said part and wherein the orbital motion imparted to said media in at least one of said bodies of finishing media is in a direction corresponding to the longitudinal dimension of said part but opposite to said first direction.

41. The method of claim 38, wherein a plurality of bodies of media are provided sequentially and wherein the orbital motion imparted to said media in at least one of said bodies is in the direction of feed of said part and wherein the orbital motion imparted to said media in at least one of said bodies of finishing media is in a direction opposite to the direction of feed of said part.

* * * * *

UNITED STATES PATENT AND TRADEMARK OFFICE

CERTIFICATE OF CORRECTION

PATENT NO. : 4,630,401

DATED : December 23, 1986

INVENTOR(S) : Gary L. McNeil

It is certified that error appears in the above-identified patent and that said Letters Patent is hereby corrected as shown below:

Col. 1, line 28; "finising" should read -- finishing --

Col. 3, line 16; "particulte" should read -- particulate --

Col. 15, line 11; "partcular" should read -- particular --

Col. 15, line 53; "it" should read -- It --

Signed and Sealed this

Twentieth Day of October, 1987

*Attest:*

DONALD J. QUIGG

*Attesting Officer*

*Commissioner of Patents and Trademarks*